United States Patent [19]

Stacy

[11] Patent Number: 4,509,676

[45] Date of Patent: Apr. 9, 1985

[54] ROTARY POST OFFICE BOX AND EQUIPMENT ENCLOSURE

[75] Inventor: George F. Stacy, Traverse City, Mich.

[73] Assignee: HSS Industries, Inc., Traverse City, Mich.

[21] Appl. No.: 563,674

[22] Filed: Dec. 20, 1983

[51] Int. Cl.[3] ..... B65D 91/00

[52] U.S. Cl. ..... 232/43.4; 232/27; 232/28; 109/48; 312/305; 312/125

[58] Field of Search ..... 109/57, 56, 58, 47, 109/55, 45, 48, 49; 232/20, 27, 28, 43.4, 43.5; 312/200, 202, 305, 197, 97.1, 125

[56] References Cited

U.S. PATENT DOCUMENTS

| | | | |
|---|---|---|---|
| 256,296 | 4/1882 | Currier | 312/305 |
| 894,577 | 7/1908 | Bessner | 232/27 |
| 1,104,153 | 7/1914 | Steward . | |
| 1,459,031 | 6/1923 | Murphy . | |
| 1,534,920 | 4/1925 | Cox | 232/27 |
| 4,258,966 | 3/1981 | Grubb | 312/305 |

FOREIGN PATENT DOCUMENTS

| | | | |
|---|---|---|---|
| 66500 | 12/1982 | European Pat. Off. | 109/48 |
| 133338 | 11/1931 | Fed. Rep. of Germany | 232/21 |

*Primary Examiner*—Gene Mancene
*Assistant Examiner*—John G. Weiss
*Attorney, Agent, or Firm*—Ian C. McLeod

[57] ABSTRACT

The present invention relates to an equipment (12) enclosure which is particularly adapted for post office use is described. In particular the present invention relates to a post office box or related equipment (12) enclosure which has an inner unit (11) which rotates in a housing (10) so that the inner unit can expose equipment on one side (**10*b*) for customer use and provide secure access for reloading of the equipment by means of doors (31) or the like on the back side of the equipment. The equipment is particularly adapted to mount standard mailbox inserts (12) having locking doors (12*a***).

9 Claims, 8 Drawing Figures

ROTARY POST OFFICE BOX AND EQUIPMENT ENCLOSURE

BACKGROUND OF THE INVENTION (1) Field of the Invention

The present invention relates to an equipment (12) enclosure including a housing (10) supporting a rotatable inner holder unit (11) for the equipment (12). In particular the present invention relates to an enclosure wherein the inner holder unit supports an array of standard mailbox inserts for post office use.

(2) Prior Art

The prior art has provided an enclosure or box which is secured to a wall of a post office by means of a hinge on one side of the box and a locking means or clasp on the other side. The box is moved at an angle to the wall to provide access to the backside for loading of mail. Mail is accessed from the front by the user. Such units require considerable space for opening and closing.

The prior art has also described joining several of such boxes together to form circular or oval modules with the back side in the center. In this configuration a door is provided into the center of the carousel in one of the modules for mail loading.

Other mailboxes are shown by U.S. Pat. Nos. 1,104,153 and 1,459,031. Generally the mailbox art is relatively static with few equipment changes. The problem has been to reduce the space necessary for positioning the boxes in the post offices or the like so that they can be securely locked from user intrusion and yet are conveniently loaded by the post office.

OBJECTS

It is therefore an object of the present invention to provide an equipment enclosure which enables loading and use in a minimum amount of space in the post office. Further it is an object of the present invention to provide a secure enclosure which is simple and economical to construct. These and other objects will become increasingly apparent by reference to the following description and the drawings.

IN THE DRAWINGS

Figure 1:
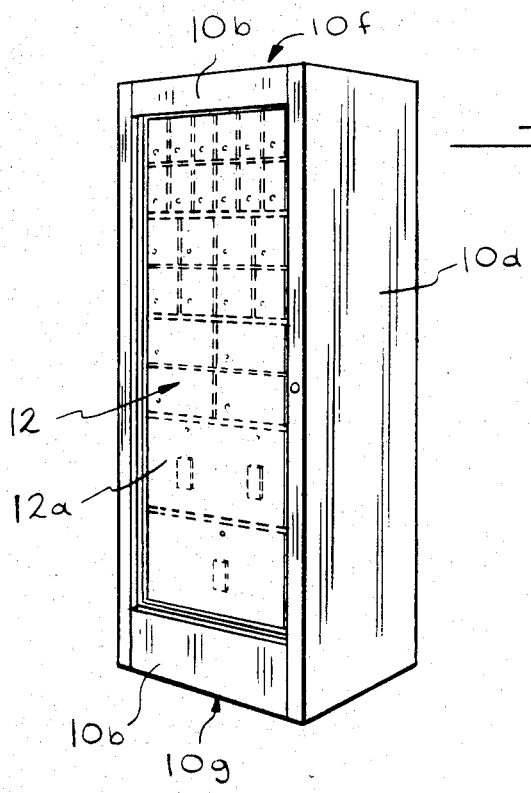
FIG. 1 is an isometric view of the enclosure of the present invention with a housing (10) supporting a rotatable holder insert (11), and particularly illustrating a preferred use with multiple standard mailbox inserts (12).
Figure 3:
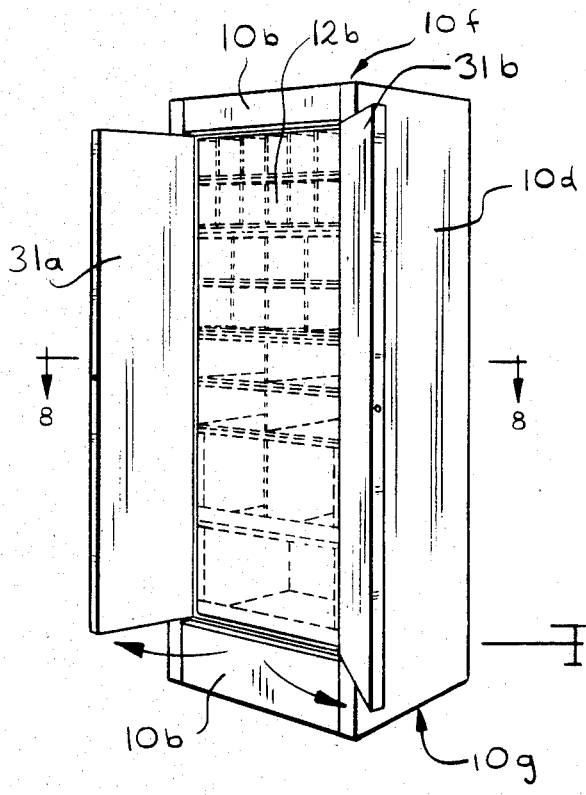

FIG. 3 is a front isometric view of the enclosure of FIG. 1 with the holder unit (11) half rotated at an angle of about 180° particularly illustrating back openings 12*b* in the preferred mailbox inserts (12) and also closure means or doors (31*a* and 31*b*) mounted on the holder unit (11) for closure of the back openings 12*b*.

Figure 2:
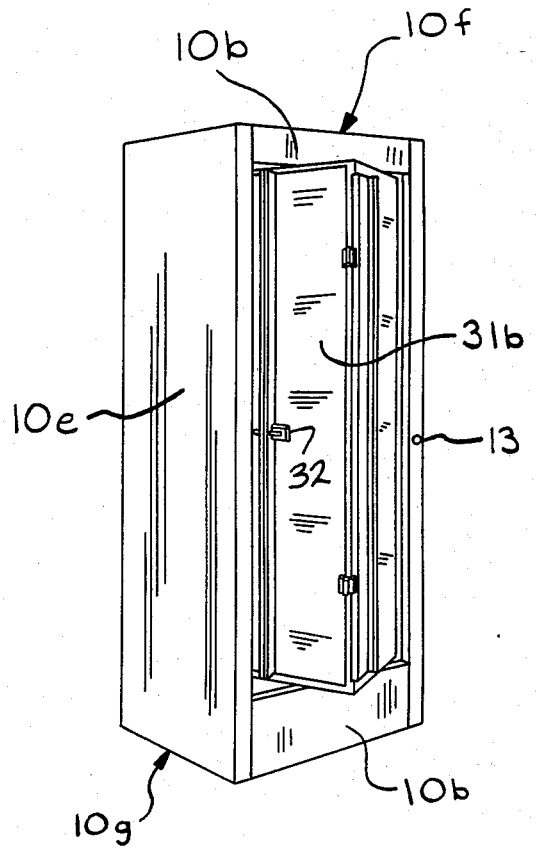
FIG. 2 is a front isometric view of the enclosure of FIG. 1 with the holder unit (11) partially rotated in the housing (10).
Figure 4:
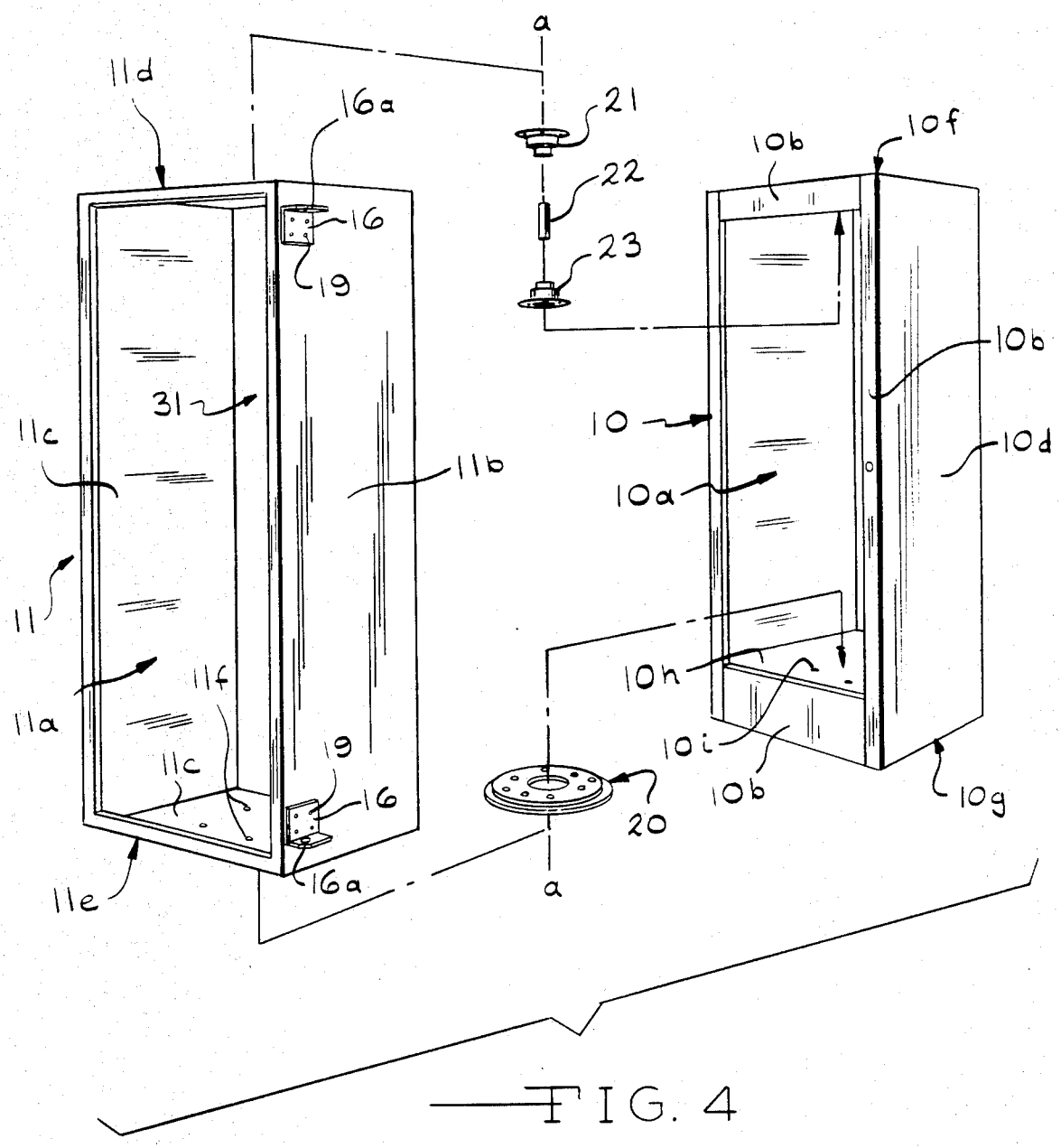

FIG. 4 is a front isometric exploded view of the enclosure of FIGS. 1 to 3, particularly illustrating the bearings (20, 21, 22, 23) for rotatably mounting the holder unit (11) in the housing (10).

Figure 5:
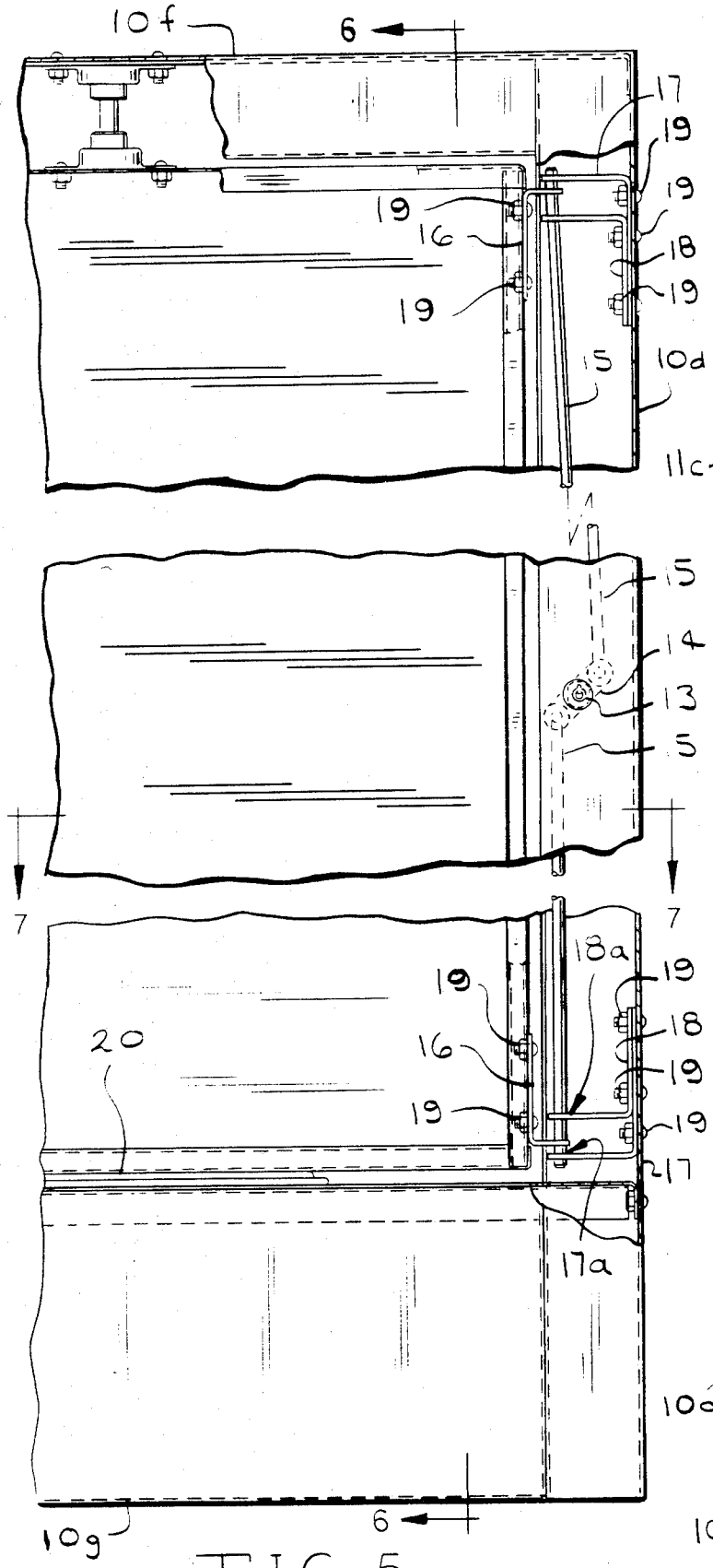

FIG. 5 is a front partial cross-sectional view of the enclosure of FIG. 1, particularly illustrating a preferred locking means (13, 14, 15, 16, 17, 18, 19) for securing the holder unit (11) in the housing (10) with the user side of the equipment (12) exposed in an opening (10*a*) in the housing (10) and further illustrating the positioning of the bearing means (20, 21, 22, 23).

Figure 6:
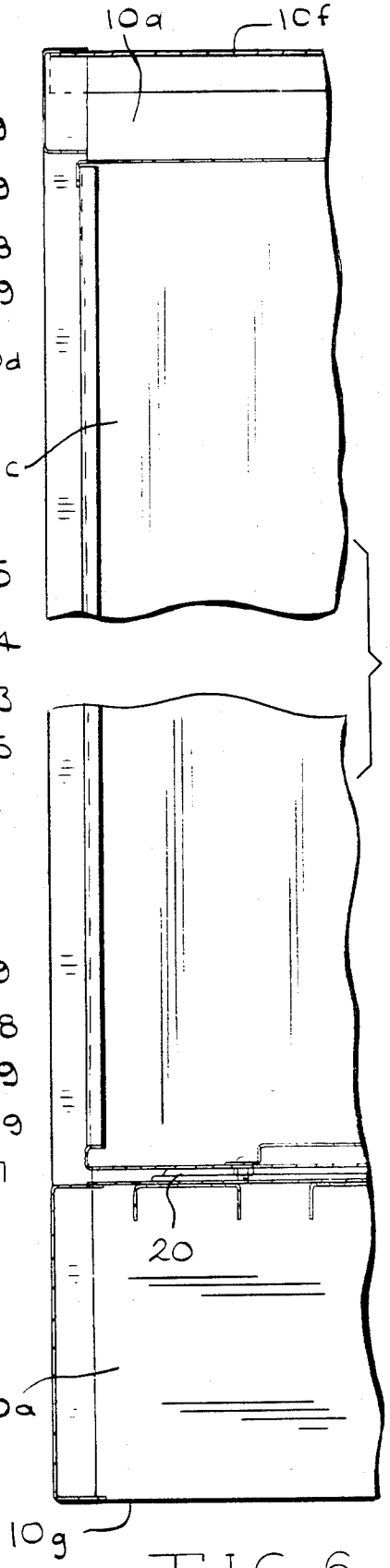

FIG. 6 is a front partial cross-sectional view of the housing (10) and holder unit (11) along 6—6 of FIG. 5.

Figure 7:
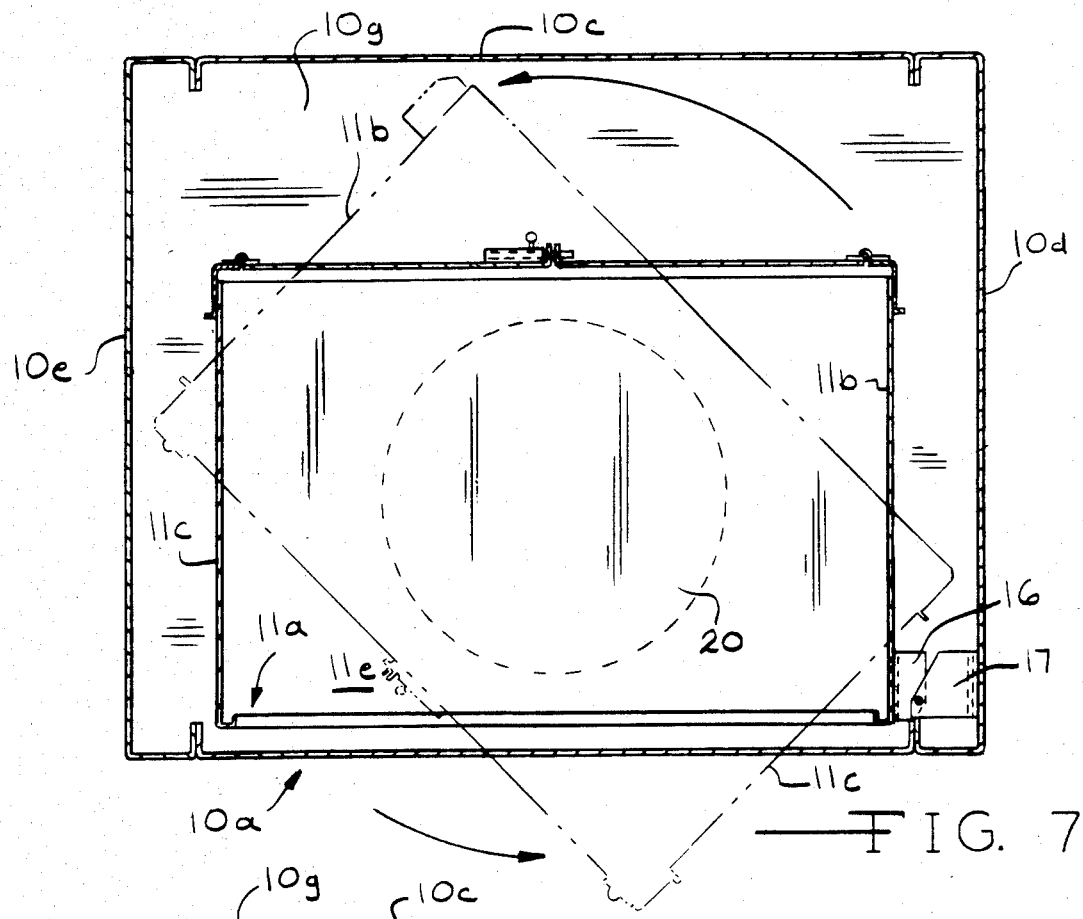

FIG. 7 is a plan cross-sectional view of the housing (10) with the inner holder unit (11) shown in broken lines when partially rotated at an angle of about 45°.

Figure 8:
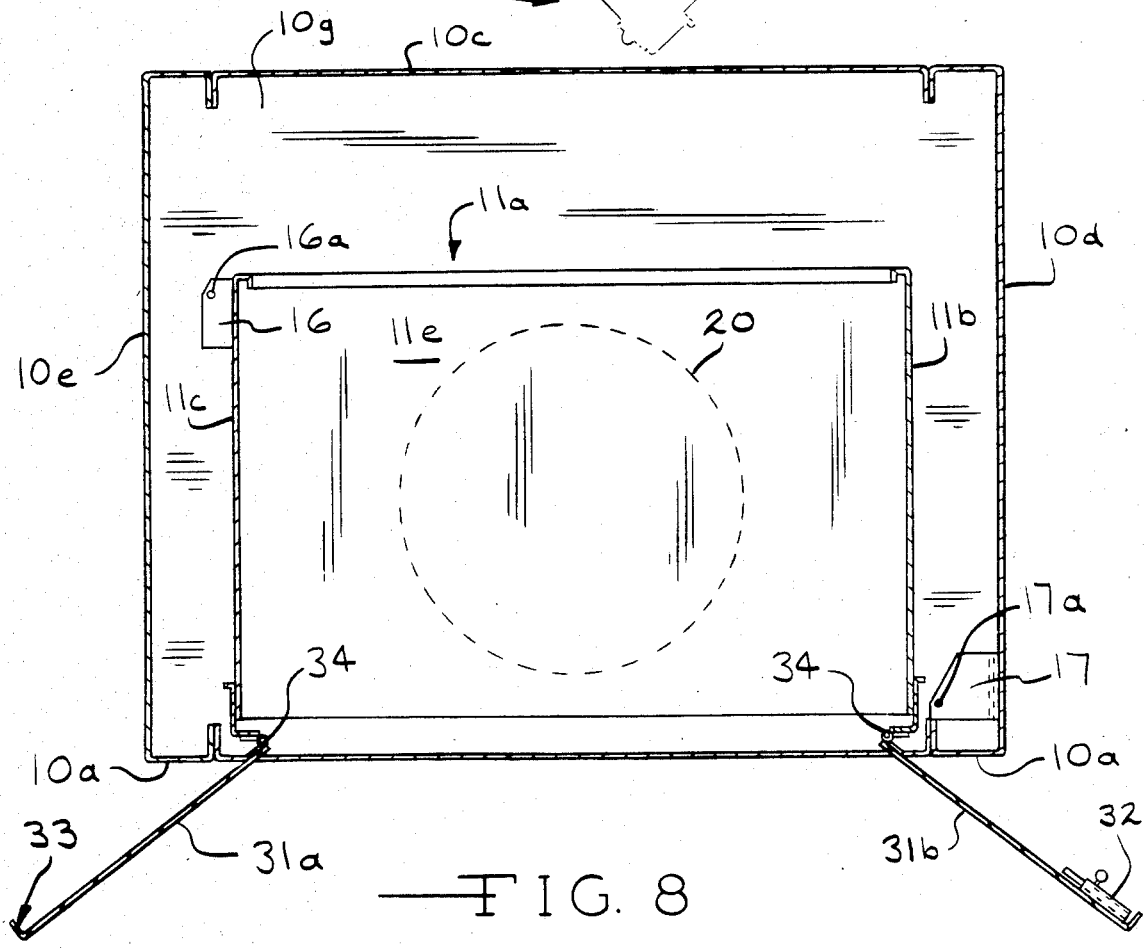

FIG. 8 is a plan cross-sectional view of FIG. 3 along line 8—8, particularly showing the closure means or door (31) exposed in the housing (10) and the holder unit (11) rotated 180°.

GENERAL DESCRIPTION

The present invention relates to an equipment enclosure which comprises:

(a) an enclosed housing (10) having a first vertically oriented first opening (10*a*) on one side (10*b*);

(b) a holder unit (11) having a second vertically oriented opening (11*a*) mounted within the housing so as to be rotatable on a vertical axis (a—a) in the housing to align the second opening on a first side of the holder unit adjacent the first opening in the housing, wherein equipment (12) can be mounted in the second opening on the holder unit when the first and second openings are aligned for access by a user and wherein the holder unit can be rotated in the housing to provide access to a side (31) of the holder unit and a back side of the equipment; and (c) locking means (13, 14, 15, 16, 17, 18, 19) acting between the housing and the holder unit which when locked prevents the rotation of the holder unit in the housing so that the second opening can be aligned and locked in position adjacent the first opening in the housing and so that when the locking means is unlocked, the second opening can be rotated into the housing in order to provide the access to the back side of the holder unit.

In particular the present invention relates to a post office box enclosure which comprises:

(a) an enclosed housing (10) having a first vertically oriented first opening (10*a*) on one side;

(b) a holder unit (11), adapted to mount standard mailbox inserts (12) in a vertically oriented second opening (11*a*) in the holder unit so as to provide an array of such inserts, each insert having locking doors (12*a*) leading into the inserts and having back openings (12*b*) for insertion of mail into the inserts, wherein the holder unit is mounted within in the housing so as to be rotatable on a vertical axis (a—a) to align the doors of the array of inserts in the first opening in the housing or to expose the back openings in the array of inserts in the first opening in the housing; and (c) locking mean (13, 14, 15, 16, 17, 18, 19) acting between the housing and the holder unit which when locked prevents the rotation of the holder unit so that the locking doors of the inserts when installed can be exposed and the array locked in position in the first opening in the housing and so that when the locking means is unlocked, the second opening can be rotated into the first opening of the housing for loading of mail into the back openings in the mailbox inserts.

SPECIFIC DESCRIPTION

Referring to FIGS. 1 to 8, the preferred enclosure of the present invention is shown. A housing 10 is provided rotatably supporting an inner holder unit 11. The housing 10 has an opening 10*a* on one side 10*b* for exposure or access to the holder unit 11. A housing rear wall 10*c* and side walls 10*d* and 10*e* as well as a top wall 10*f* and bottom wall 10*g* provide the housing 10. (See FIGS. 7 and 8). The inner holder unit 11 includes a second opening 11*a*, holder side walls 11*b* and 11*c* and holder top and bottom walls 11*d* and 11*e*.

The holder unit 11 is rotatably mounted in the housing 10 and holder unit 11 at the tops 10*f* and 11*d* by means of upper bearings 21 and 23 separated by a post 22 upon which the bearings 21 are journaled. The lower bearing 20 is a pancake type bearing mounted on a plate 10*h* inside the housing 10 and to the bottom 11*e* of the holder unit 11. The bearing 20 is secured to the plate 10*h* by means of bolts (not shown) in holes 10*i* and 11*f*. Various forms of equipment such as mailboxes 12 can be provided in the opening 11*a* of the holder unit 11.

Referring to FIG. 5, the holder unit 11 is secured in the housing 10 by a locking means. The locking means includes a lock 13 outside of the housing 10 and a pivot arm 14 inside the housing 10 adjacent the holder unit 11 on one side 10*d*. The pivot arm 14 mounts rods 15 vertically oriented along the side 10*d* which are moved by the pivot arm 14 into and out of slots 16*a* in a tab 16. The tab 16 is secured to the holder unit 11 by bolts and nuts 19. The rods 15 are supported by guides 17 and 18 with slots 17*a* and 18*a* which are secured to housing 10 by means of bolts 19. Thus by turning a key (not shown) in lock 13 the pivot arm 14 is rotated and rods 15 are moved into out of a locking position in the tab 16 with a linear movement of the rod 15 in the guides 17 and 18. As shown in FIG. 5, the holder unit 11 and housing 10 are secured together by the locking means to prevent rotation of the holder unit 11.

The back of the holder unit 11 (FIGS. 7 and 8) is provided with a cover 31, including doors 31*a* and 31*b*. As can be seen, the doors 31*a* and 31*b* open to allow access to the back of the holder unit 11 and the back side 12*b* of the mailbox inserts 12*a*. The backside 12*b* is exposed for insertion of mail by the post office. The doors 31*a* and 31*b* when closed are secured by a sliding latch 32 or other securing means mounted on one door 31*b* which slides into an opening 33 in the other door 31*a*. The doors 31*a* and 31*b* are mounted on the inner housing 11 by means of hinges 34.

As can be seen in one position, the holder unit 11 is secured by the locking means in the housing 10 with the openings 10 and 11*a* aligned as shown in FIG. 1. Thus the word "aligned" means that the openings are essentially facing each other and are vertically oriented as defined by the wall 10*b*. In this position the postal boxes 12 and doors 12*a* are accessible by the user for mail collection. When the post office wants to load mail in the boxes the holder unit 11 is rotated into a second position 180° from the first position, the doors 31*a* and 31*b* are opened and the mail is loaded into the back side of the array of mailbox inserts 12. The doors 31*a* and 31*b* are then closed, the latch 32 secured in opening 33 and the holder unit is rotated 180° again and relocked.

The holder unit 11 can support various kinds of equipment such as stamp dispensers and the like (not shown). The unit is also adapted for mail deposit by providing a slot in a face sheet (not shown) in opening 11*a* in holder unit 11. The enclosure can also be used for non-mail purposes. The housings can be joined together in modules. All of these variations will be obvious to those skilled in the art.

As can be seen from the foregoing description, the present invention provides a simple and economical means for mail handling in a floor area essentially defined by the bottom 10*g* of the housing 10 and a space for user access to the enclosure. The enclosure is inexpensive and relatively easy to construct.

It is intended that the foregoing description be only illustrative of the present invention. It is intended that the invention be limited only by the claims.

I claim:

1. An enclosure for a plurality of boxes which comprises:

(a) an enclosed housing (10) having a single first vertically oriented first opening (10*a*) on one side (10*b*);

(b) a holder unit (11) having a vertically oriented second opening (11*a*) mounted within the housing so as to be rotatable on a vertical axis (a—a) in the housing to align the second opening on a first side of the holder unit adjacent the first opening in the housing, wherein the boxes are (12) mounted in the holder unit and are accessible by a user in a first position when the first and second openings are aligned, and wherein the holder unit is rotated in the housing to provide access to a back side of the boxes in a second position;

(c) locking means (13, 14, 15, 16, 17, 18, 19) acting between the housing and the holder unit which when locked prevents the rotation of the holder unit in the housing so that the second opening can be aligned and locked in position adjacent the first opening in the housing and so that when the locking means is unlocked, the second opening can be rotated into the housing in order to provide the access to the back side of the holder unit; and (d) a covering on the holder unit over the back side of the holder unit with a lock which can be opened to provide access to the boxes in the second position through the first opening of the enclosed housing.

2. The enclosure of claim 1 wherein the housing and holder unit are rectangular in vertical cross-section.

3. The enclosure of claim 2 wherein the housing and holder unit are correspondingly rectangular in horizontal cross-section.

4. The enclosure of claim 1 wherein the locking means is mounted on the housing adjacent to the vertically oriented first opening in the housing and wherein the locking means includes a tab (16) with a slot (16*a*) mounted on the holder unit into which a rod (15) which is vertically oriented slides upon turning a key in the lock (13) to turn a pivot arm (14) upon which the rod is mounted inside the housing.

5. The enclosure of claim 4 wherein there are two separate rods one above the other and tabs and wherein each rod is mounted on the pivot arm (14) which is rotated by turning the key in the lock.

6. The enclosure of claim 1 wherein bearing means (20, 21, 22 and 23) are mounted on the vertical axis (a—a) at opposite ends of the holder unit and on the housing for rotation of the holder unit.

7. The enclosure of claim 6 wherein the bearing means includes a pancake bearing (20) at the bottom of the holder unit mounted on the housing.

8. A post office box enclosure which comprises:

(a) an enclosed housing (10) having a single first vertically oriented first opening (10*a*) on one side;

(b) a holder unit (11), adapted to mount standard mailbox inserts (12) in a vertically oriented second opening (11*a*) in the holder unit so as to provide an array of such inserts, each insert having locking doors (12*a*) leading into the inserts and having back openings (12*b*) for insertion of mail into the inserts, wherein the holder unit is mounted within in the housing so as to be rotatable on a vertical axis (a—a) to align the doors of the array of inserts in the first opening in the housing or to expose the back openings in the array of inserts in the first opening in the housing;

(c) locking means (13, 14, 15, 16, 17, 18, 19) mounted on the housing acting between the housing and the holder unit actuated by turning a key in a lock (13) to move a pivot arm (14) mounting dual vertically oriented rods (15) one above the other which provide locking and unlocking by movement into and out of slots in two separate tabs for each rod mounted on the holder unit and which when locked prevents the rotation of the holder unit and which when locked prevents the rotation of the holder unit so that the lockiing doors of the inserts when installed can be exposed and the array locked in position in the first opening in the housing and so that when the locking means is unlocked, the back openings can be rotated into the first opening of the housing for loading of mail into the back openings in the mailbox inserts; and (d) at least one door (31) mounted on the holder unit to provide closure of the back openings of the mailbox inserts and which can be opened to provide access to the back openings through the first opening of the enclosed housing.

9. The post office box enclosure of claim 8 wherein there are two locking doors on the back openings which are locked together by a sliding bolt (32).

* * * * *

UNITED STATES PATENT AND TRADEMARK OFFICE

CERTIFICATE OF CORRECTION

PATENT NO. : 4,509,676

DATED : 1985 April 9

INVENTOR(S) : George F. Stacy

It is certified that error appears in the above-identified patent and that said Letters Patent are hereby corrected as shown below:

Column 2, line 47, after "within" delete "in".

Column 2, line 52, "mean" should be --means--.

Column 3, line 27, insert --and-- after "into".

Column 4, line 68, after "within" delete "in".

Column 5, line 14, after "unit" delete "and which when locked prevents the rotation of the holder unit"

Column 5, line 16 "lockiing" should be --locking--.

Signed and Sealed this

*Twenty-third* Day of *July 1985*

[SEAL]

*Attest:*

DONALD J. QUIGG

*Attesting Officer* *Acting Commissioner of Patents and Trademarks*